US012252303B2

(12) United States Patent
Lantz et al.

(10) Patent No.: US 12,252,303 B2
(45) Date of Patent: Mar. 18, 2025

(54) TAMPER-EVIDENT ENCLOSURE FOR ZIPPERS INCLUDED ON SECURITY CARRIERS

(71) Applicant: A. Rifkin Co., Hanover Township, PA (US)

(72) Inventors: Paul D. Lantz, Kingston, PA (US); Donald R. Casterline, Mountain Top, PA (US); Robert J. Cohn, Dallas, PA (US)

(73) Assignee: A. Rifkin Co., Hanover Township, PA (US)

( * ) Notice: Subject to any disclaimer, the term of this patent is extended or adjusted under 35 U.S.C. 154(b) by 153 days.

(21) Appl. No.: 18/081,236

(22) Filed: Dec. 14, 2022

(65) Prior Publication Data

US 2023/0182967 A1 Jun. 15, 2023

Related U.S. Application Data

(60) Provisional application No. 63/289,799, filed on Dec. 15, 2021.

(51) Int. Cl.
*B65D 33/25* (2006.01)

(52) U.S. Cl.
CPC ..... *B65D 33/2585* (2020.05)

(58) Field of Classification Search
CPC ..... B65D 33/2585
USPC ..... 383/5, 97
See application file for complete search history.

(56) References Cited

U.S. PATENT DOCUMENTS 3,978,697 A * 9/1976 Bako ..... A44B 19/301 70/68
4,031,724 A * 6/1977 Atkinson ..... A44B 19/301 70/68
6,360,411 B1 * 3/2002 Bortz ..... A44B 11/2576 24/625

(Continued)

FOREIGN PATENT DOCUMENTS

CN 110937242 A * 3/2020 ..... B65D 33/004
EP 1311170 B1 * 3/2008 ..... A44B 19/301

(Continued)

OTHER PUBLICATIONS

Machine translation of WO2009112078A1 (Year: 2009).*

*Primary Examiner* — Jes F Pascua
(74) *Attorney, Agent, or Firm* — Wendy W. Koba

(57) ABSTRACT

A tamper-evident security device to be used in conjunction with a slidable closure on a carrier bag comprises a bottom component (positioned within the bag itself) and a top component attached to a front panel of the carrier bag so to be located over the bottom component. The top and bottom components are fixed together in an immovable form, and the top component includes a recess for supporting the slider mechanism of the slidable fastener. A lid component is coupled to the top component via a hinge element, wherein upon closure of the lid component over the top component, the slider mechanism of the fastener is fully enclosed. A provided frangible seal (included to indicate possible attempts to tamper with the closure) is attached to the security device, with an end portion of the top component including a cover tab to hold the frangible seal in place as the carrier bag is handled during transport.

9 Claims, 7 Drawing Sheets

(56) References Cited

U.S. PATENT DOCUMENTS

| | | | | |
|---|---|---|---|---|
| 6,533,335 | B2 | 3/2003 | Hudson | |
| 7,273,139 | B2 * | 9/2007 | Lantz | A44B 19/301 292/307 R |
| 7,370,892 | B2 | 5/2008 | Collingham | |
| 7,988,209 | B2 | 8/2011 | Hudson | |
| 10,687,589 | B2 | 6/2020 | Goldberg et al. | |
| 10,913,576 | B2 | 2/2021 | Crisp | |
| 2010/0142857 | A1 * | 6/2010 | Bortz | B65D 33/2585 383/5 |
| 2017/0295892 | A1 * | 10/2017 | Goldberg | B65D 33/2541 |

FOREIGN PATENT DOCUMENTS

| | | | | |
|---|---|---|---|---|
| WO | WO-2009112078 | A1 * | 9/2009 | A44B 19/301 |
| WO | WO-2011057325 | A1 * | 5/2011 | B65D 33/2591 |

* cited by examiner

TAMPER-EVIDENT ENCLOSURE FOR ZIPPERS INCLUDED ON SECURITY CARRIERS

CROSS-REFERENCE TO RELATED APPLICATIONS

This application claims the benefit of US Provisional Application 63/289,799, filed Dec. 15, 2021, which is herein incorporated by reference.

TECHNICAL FIELD

The present invention relates to configurations for security pouches and other types of carriers used to transport critical goods and, more particularly, to a security carrier including a tamper-evident covering (enclosure) for the zipper used to access the interior of the security carrier.

BACKGROUND OF THE INVENTION

Various businesses and industries still require the transport and exchange of documents, currency, and other physical items (jewelry, prescription drugs, or the like). These articles are typically placed in a secure carrier in the form of an envelope, bag, or the like, with a zip slider used to close the carrier. In order to prevent tampering of the contents within the carrier, a security device may be fitted with the zip slider, where the security device includes a disposable numbered identification tag which must be broken to release the slider. Any tampering is clearly visible if the tag has been broken. It is not possible to substitute a tag that has been broken to avoid suspicion that the carrier has been compromised inasmuch as each tag has its own unique number, with a no-repeat in several million numbered combinations.

Examples of previous types of security devices as developed by the Applicant are described in U.S. Pat. Nos. 6,533,335 and 7,988,209, both of which are incorporated herein in their entirety. While useful, portions of these security devices remain coupled to zipper pull itself, making the use of the zipper rather awkward.

SUMMARY OF THE INVENTION

An updated tamper-evident security enclosure has been developed that is positioned along a portion of a carrier panel so as to fully capture and enclose the slider component of a zipper when fully closed. In contrast to various prior art arrangements that require a portion of the enclosure to be permanently attached to the zipper pull (which makes the operation of the zipper somewhat cumbersome), all elements of the inventive tamper-evident enclosure are attached to the carrier itself and positioned perpendicular to the travel direction of the zipper such that when the zipper is closed, the slider portion of the zipper is locked within the tamper-evident enclosure.

An exemplary embodiment of the present invention may be configured as a security enclosure for use with a carrier bag including a slidable fastener used to provide permitted access to the carrier bag. In particular, the security enclosure comprises a bottom component disposed within the carrier bag itself, along the underside of a front panel of the carrier bag and positioned to overlap with the termination location of the slidable fastener. A top component is disposed over the front panel of the carrier bag to be in alignment with the bottom component in a manner where the top and bottom components are fixed together in an immovable form. The top component includes a recess for supporting the slider mechanism of the fastener when the fastener is fully closed. A lid component is coupled to the top component via a hinge element, whereupon closure of the lid component over the top component, the slider mechanism is fully enclosed, with a provided frangible seal positioned to fix the position of the lid component with respect to the top component.

Other and further embodiments and features of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 1:
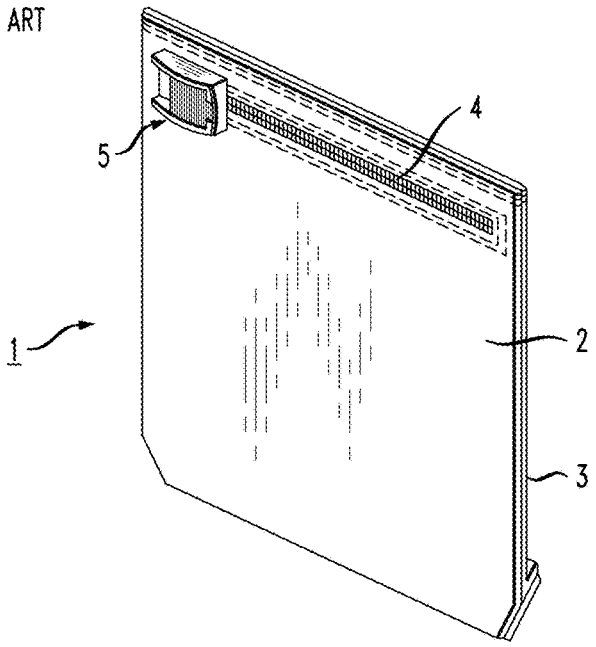
FIG. 1 PRIOR ART
FIG. 1 is an isometric view of a conventional carrier bag formed to have a zippered closure and a security device attached to the zipper.

As mentioned above, re-useable carriers are commonplace for the secure transportation of documents, financial paper, and the like, between various offices of a business or government department. FIG. 1 depicts a typical type of carrier bag 1, which may be formed of a sturdy material such as a canvas or plastic, and permanently sealed around the perimeter used to join a front panel 2 to a rear panel 3 of carrier bag 1. A slide fastener 4 (typically, a zipper) is used to close an opening in carrier bag 1 to allow entry to the interior of the carrier bag. In order to prevent tampering with the contents of carrier bag 1, a security device 5 is fitted to secure zipper 4 and includes a disposable numbered identification tag (not shown) to prevent, or make evident, any unauthorized access to carrier bag 1.

Figure 2:
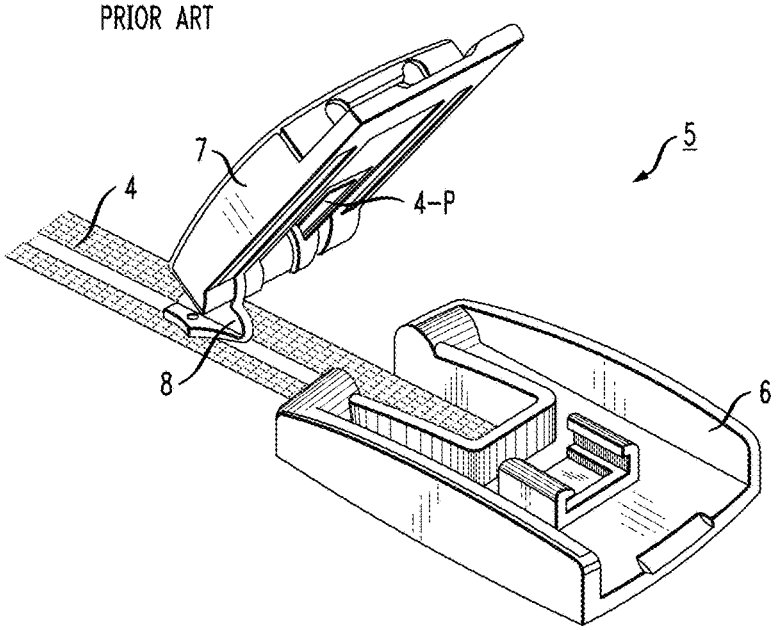
FIG. 2 PRIOR ART
FIG. 2 shows a prior art security device for use in an arrangement as shown in FIG. 1.

FIG. 2 illustrates a prior art type of security device 5 as disclosed in our previous '335 patent mentioned above. Briefly, security device 5 includes a housing 6 and a closure member 7. Housing 6 is permanently attached to carrier bag 1 at the "closed" termination of zipper 4. Closure member 7 is formed to encase a zipper pull 4-P (or other movement device) of zipper 4. Closure member 7 is sized to mate with housing 6 when the zipper is in the closed position, with an identification tag (not shown) used to maintain housing 6 and closure member 7 in a "sealed" configuration (where as mentioned above, any removal of the tag without permission to gain access to the contents of the bag clearly shows evidence of tampering). While very workable, the size and structure of closure member 7 is rather awkward when authorized personnel are either opening or closing the zipper, since closure member 7 is permanently attached to the zipper slider 8, and may even become subject to breakage from repeated and prolonged use.

The present invention, as discussed below, addresses and overcomes this problem, while retaining the overall low profile of a tamper-evident security device. As will be discussed below, all of the components forming the inventive security enclosure are disposed on the carrier bag itself, leaving a conventional zipper pull (or other movable closure mechanism) unencumbered and free to be worked in a conventional manner. The inventive security enclosure comprises a hinged, clam-shell type of configuration that will capture and enclose the slide component of a zipper in a fixed manner, using a conventional type of identification tag to dissuade tampering.

Figure 3:
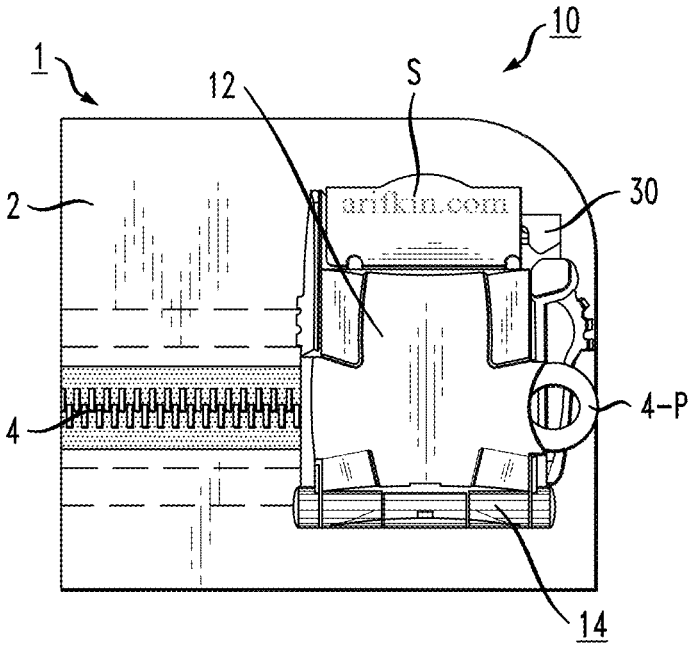
FIG. 3 is an isometric view of an exemplary security enclosure formed in accordance with the teachings of the present invention, the view of FIG. 3 showing the security enclosure in the "closed, locked" position so as to enclose the slider component of the zipper and use a frangible seal to fix the attachment of the clam-shell elements.

FIG. 3 illustrates a tamper-evident security enclosure 10 formed in accordance with the principles of the present invention as attached to front panel 2 of carrier bag 1 in the vicinity of a termination of the zipper 4. In particular, security enclosure 10 is located so that the slider 8 (not shown in this view) of zipper 4 will be captured and held in a fixed ("locked") position within security enclosure 10. An identification tag (seal) S is shown in FIG. 3 as inserted in security enclosure 10 and is used, as is known in the art, to maintain the security enclosure in its "closed" position; removal of seal S is thereafter indicative of an attempt to tamper with the carrier bag and remove its contents. In this particular embodiment, a cover element 30 is included as a part of security enclosure 10 and is positioned to cover a portion of seal S and prevent unwanted separation between the seal and the security enclosure during transport.

Figure 4:
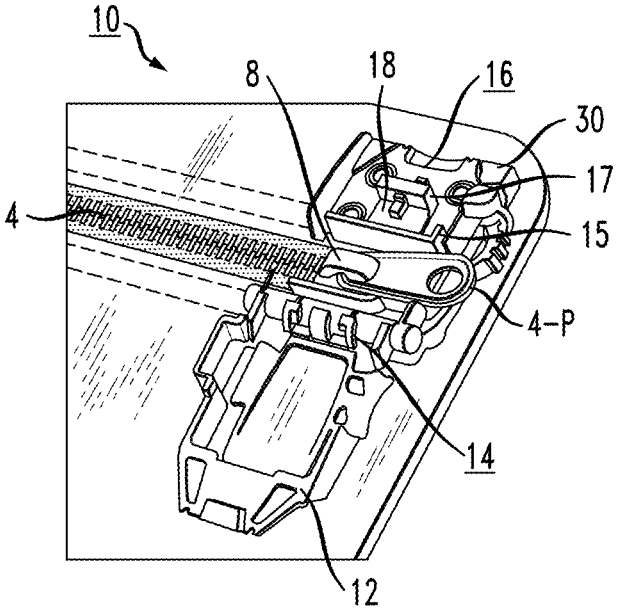
FIG. 4 is an isometric view of the security enclosure of FIG. 3, here in the "open" position, clearly illustrating the clam shell configuration of the enclosure, showing the lid, hinge and top elements of the security enclosure, with the slider fully visible in this open view.

FIG. 4 is a view of security enclosure 10 in the "open" position that clearly illustrates the placement of slider 8 within the clam-shell type of structure used to form security enclosure 10. Referring to both FIGS. 3 and 4, security enclosure 10 is shown as including a lid component 12 that opens and closes over the remainder of enclosure 10 via a hinge member 14 (thus forming the clam-shell configuration). The open view of FIG. 4 clearly shows a top component 16 of security enclosure 10, which includes a recess 18 for supporting slider 8 of zipper 4. Also shown in FIG. 4 is a pair of vertical walls 15, 17 formed within top component 16. As will be discussed below in association with FIGS. 9 and 10, these elements further limit the possibility of tampering with security enclosure 10 (i.e., attempts to remove lid 12 via working of hinge 14).

The differences in positioning and operation between prior art security device 3 of FIG. 2 and the inventive security enclosure 10 as shown in FIGS. 3 and 4 are clearly evident. The positioning of security enclosure 10 in a manner that is perpendicular to the travel of slider 8 allows for full capture and enclosure of the slider (as shown in FIG. 3) without the need to include any portion of the security enclosure on the zipper pull itself.

Figure 5:
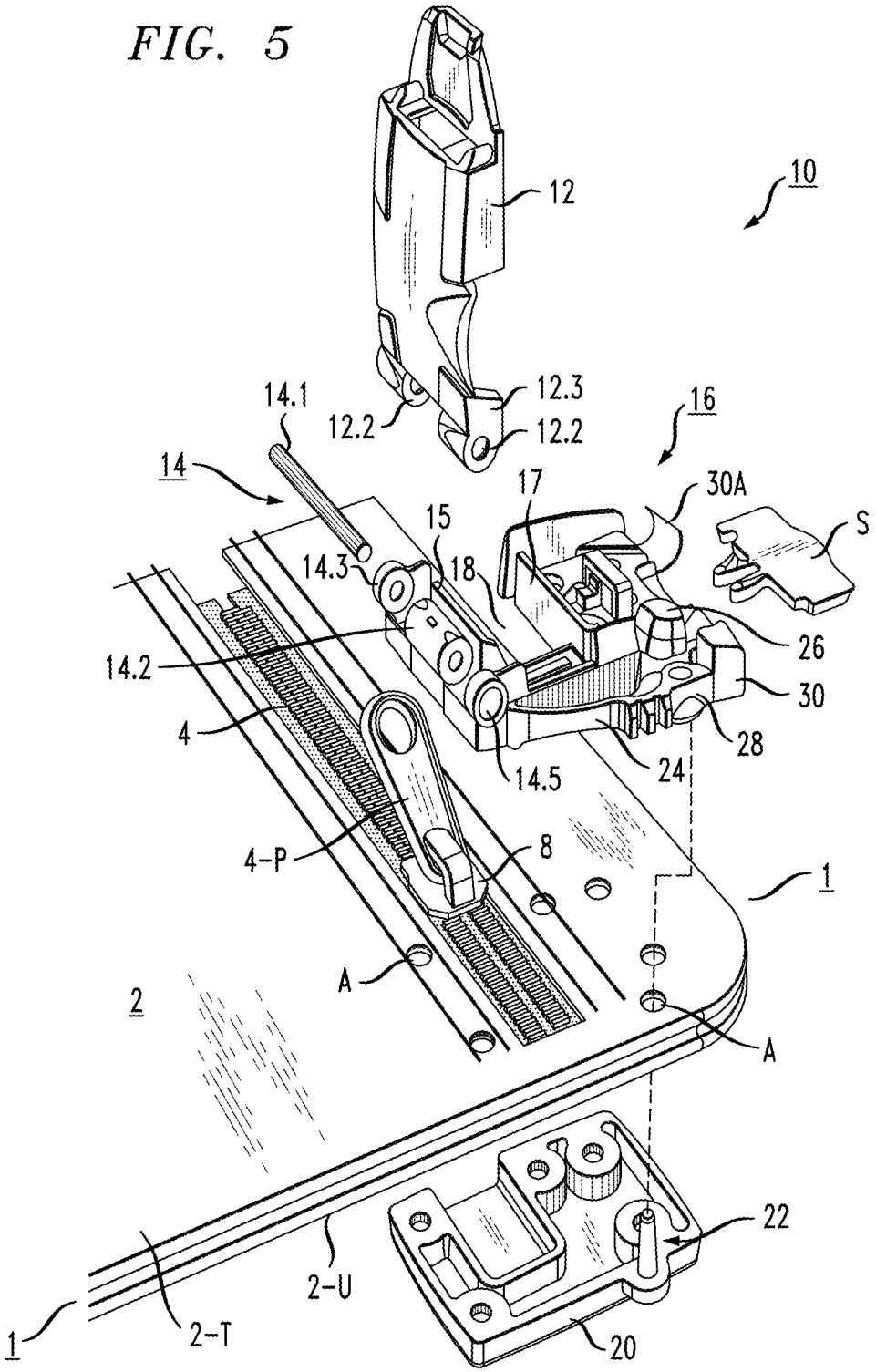
FIG. 5 is an exploded view of the components of the inventive security enclosure; namely, the lid component, top component, hinge component, and bottom component, illustrating their positions with respect to the termination of a zipper closure.

FIG. 5 illustrates, in an exploded view, an initial set of assembly steps used to attach security enclosure 10 to front panel 2 of carrier bag 1. Evident in this view is a bottom component 20 of security enclosure 10, where bottom component 20 is positioned within bag 1 so as to be in contact with the underside 2-U of front panel 2. In particular, bottom component 20 is positioned so that it will be in alignment with (and thus engage with) top component 16 of security enclosure 10 when the latter is properly positioned on top side 2-T of front panel 2. A plurality of apertures A are formed through the thickness of front panel 2 to control the alignment between top 16 and bottom 20 so that securing pins or similar devices (not shown) may be used to permanently attach these components to front panel 2 of carrier bag 1.

Figure 6:
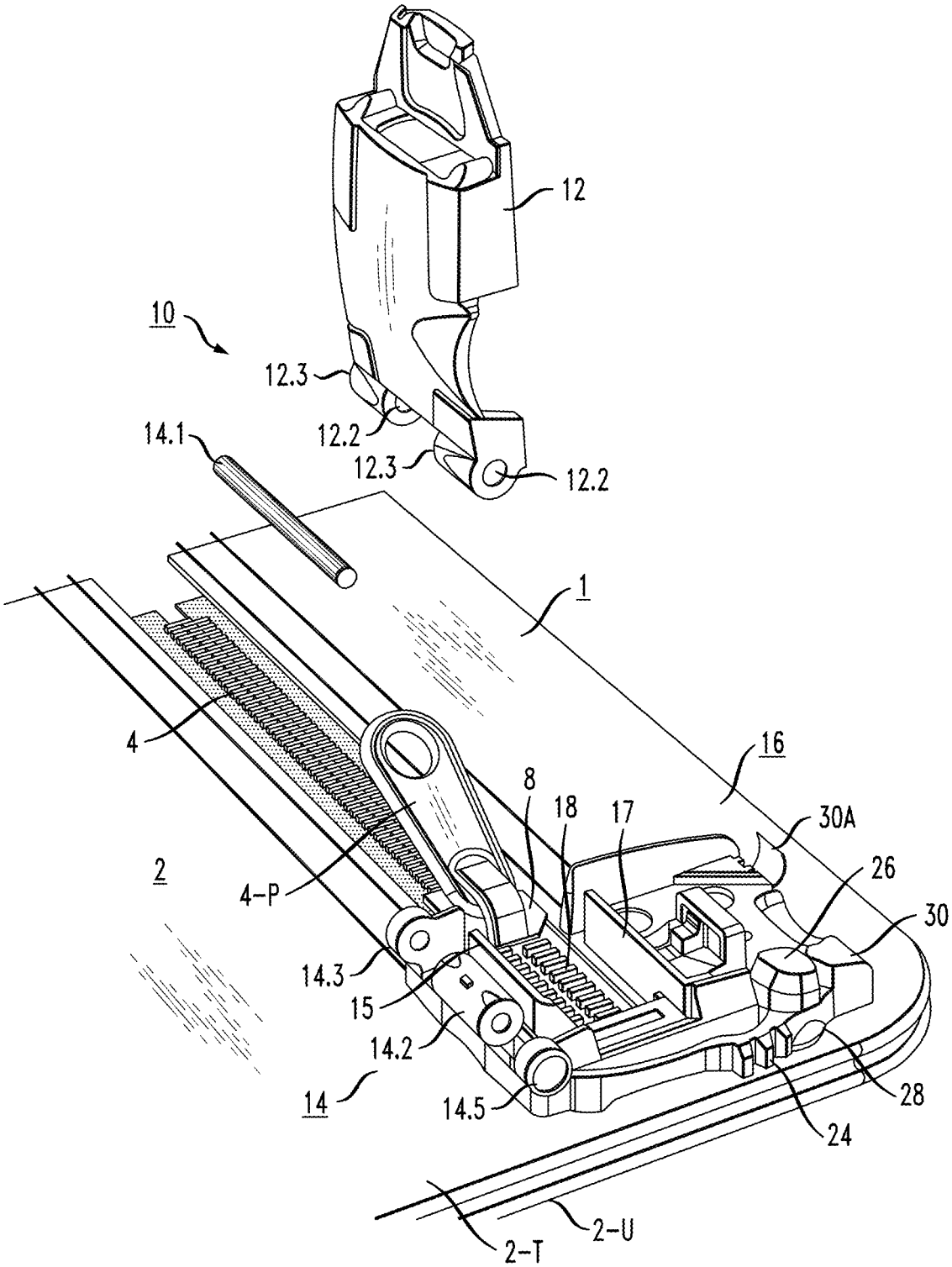
FIG. 6 is another exploded view, in this case subsequent to the joining of the bottom and top components on opposing sides of a front panel element used to form the carrier bag.

When top component 16 and bottom component 20 have been attached to one another, the assembly takes the form as shown in FIG. 6. Referring to both FIGS. 5 and 6, lid component 12 and hinge assembly 14 are also shown. Lid component 12 is formed to include a pair of apertures 12.2 that will allow for passage of a hinge pin 14.1 when lid component 12 is positioned over hinge barrel 14.2 in a manner such that hinge barrel 14.2 resides between two halves of a lid hinging portion 12.3. Hinge assembly 14 also includes a hinge aperture 14.3 for accepting hinge pin 14.1 (the opposing end 14.5 of the hinge is closed, preventing pin 14.1 from passing completely through the assembly).

Figure 7:
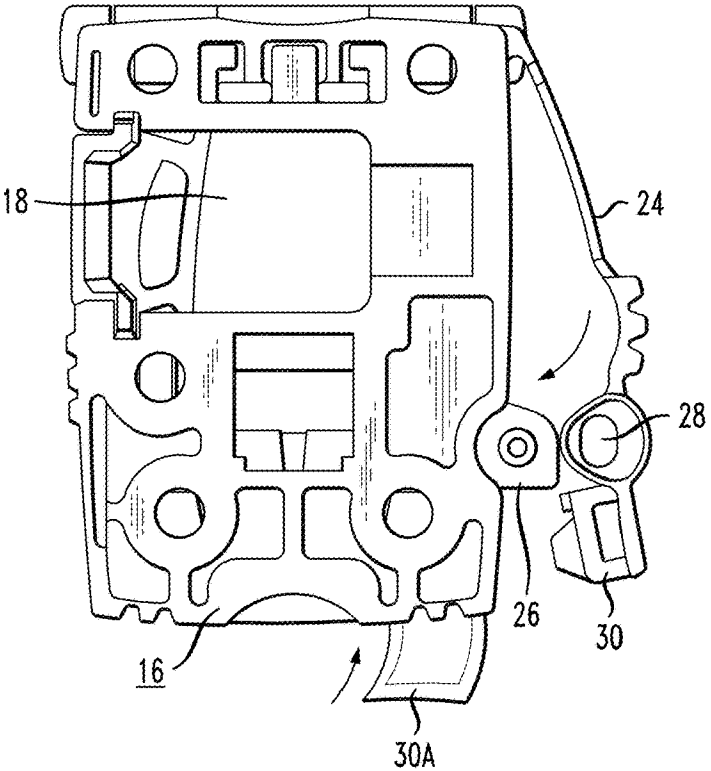
FIG. 7 is a view from the underside of the top component, in this case including a seal lock arm that pivots to engage with a pivot pin formed on the bottom component and extending upward through the thickness of the front panel of the carrier bag.

Referring in particular to FIG. 5, bottom component 20 is shown in this particular configuration as including a seal lock pivot pin 22 that will pass through the thickness of bag front 2 and then through an opening 28 formed in seal lock arm 24 (included as part of top component 16). As originally molded, seal lock arm 24 is slightly angled away from top component 16 (as best shown in FIG. 7, discussed below). When joining bottom component 20 and top component 16 together, seal lock arm 24 is pivoted into place underneath a cap 26, allowing for seal lock pivot pin 22 to pass through the thickness of front panel 2, through opening 28 in seal lock arm 24, and be enclosed by cap 26. Cover element 30 also moves when seal lock arm 24 is pivoted, ending in its final position over a portion of seal S. It is to be understood that cover element 30 as shown is only one type of additional member that may be used to maintain seal S in position. A hinged clip 30A, as shown in phantom in FIGS. 5-7, may be positioned along the far (distal) edge of top component 16 and rotated upward to again "clamp" seal S in place.

Figure 8:
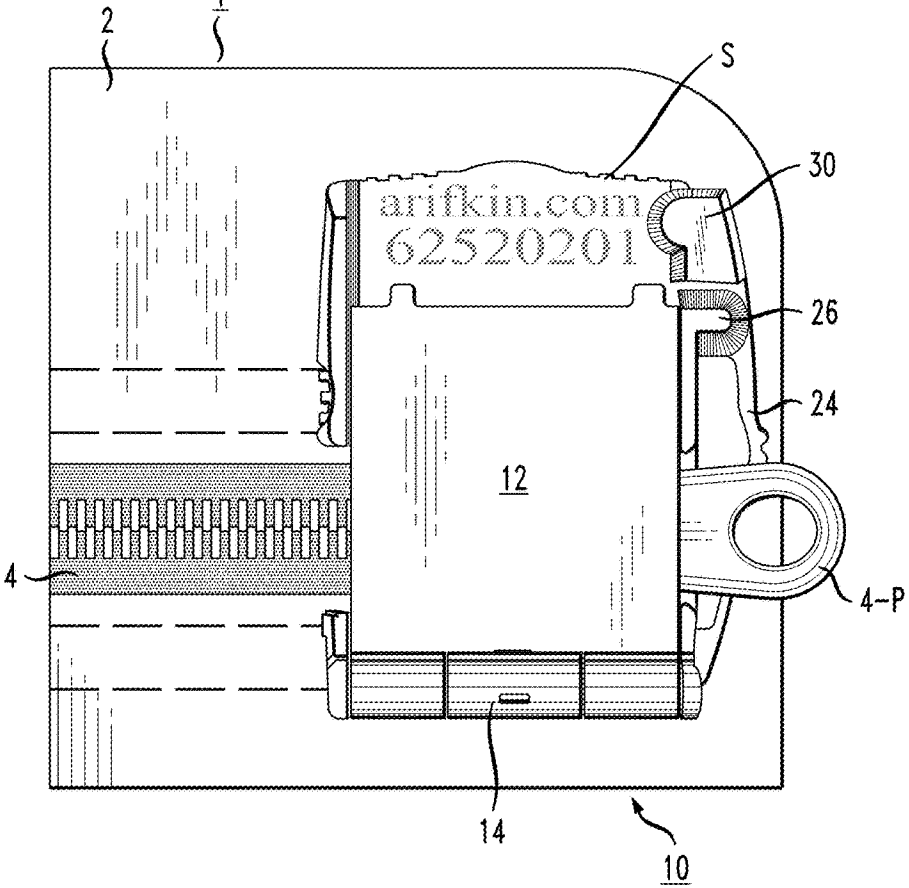
FIG. 8 is a close-up view from above the inventive security enclosure in its final, closed position, with the slider fixed in place by the security enclosure, this view in particular illustrating the use of an end portion of the seal lock arm to hold a side edge of a frangible seal in place, preventing unwanted movement of the seal during handling.

FIG. 7 is a view of the underside of top component 16, which better illustrates the location of seal lock arm 24, shown in this view in its "open" position prior to being joined to bottom component 20. Once front panel 2 of carrier bag 1 is positioned between bottom component 20 and top component 16, seal lock arm 24 is pivoted in the direction shown by the arrow in FIG. 7 until its opening 28 comes into position underneath cap 26. With reference to FIGS. 5 and 6 as discussed above, it is clear that seal lock pivot pin 22 holds arm 24 securely in place underneath cap 26 once the arm has been moved into its "closed" position. When pivoted into this closed position, cover element 30 of seal lock arm 24 will be positioned over a portion of frangible seal S, preventing the seal from being accidently snapped off during handling (e.g., during shipping, movement, etc.). FIG. 8 is a "closed" view of security enclosure 10 that clearly shows cover element 30 in position over a side portion of frangible seal S. The remainder of seal lock arm 24 is also shown in this view, as in position underneath zipper pull 4-P. Again, it is to be understood that the use of seal lock arm 24 and cover element 30 are exemplary only and many other arrangements (such as clip 30A mentioned above) may be used to secure the position of seal S with respect to top component 16.

Figure 9:
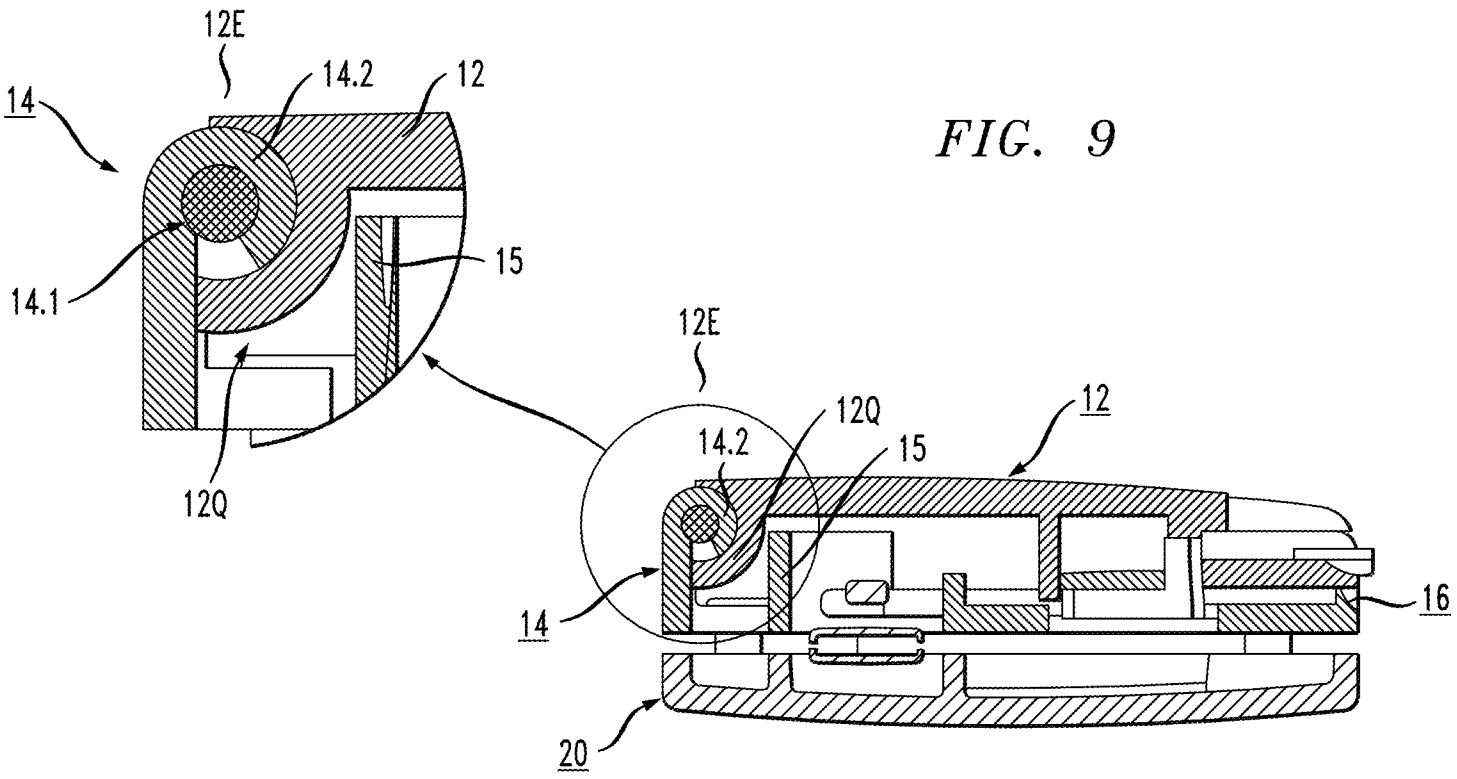
FIG. 9 is a close-up view of the hinge area of the inventive security enclosure, in this case where the lid component includes a quarter-round hinge barrel and the top component includes a vertical wall formed adjacent to the quarter-round barrel.
Figure 10:
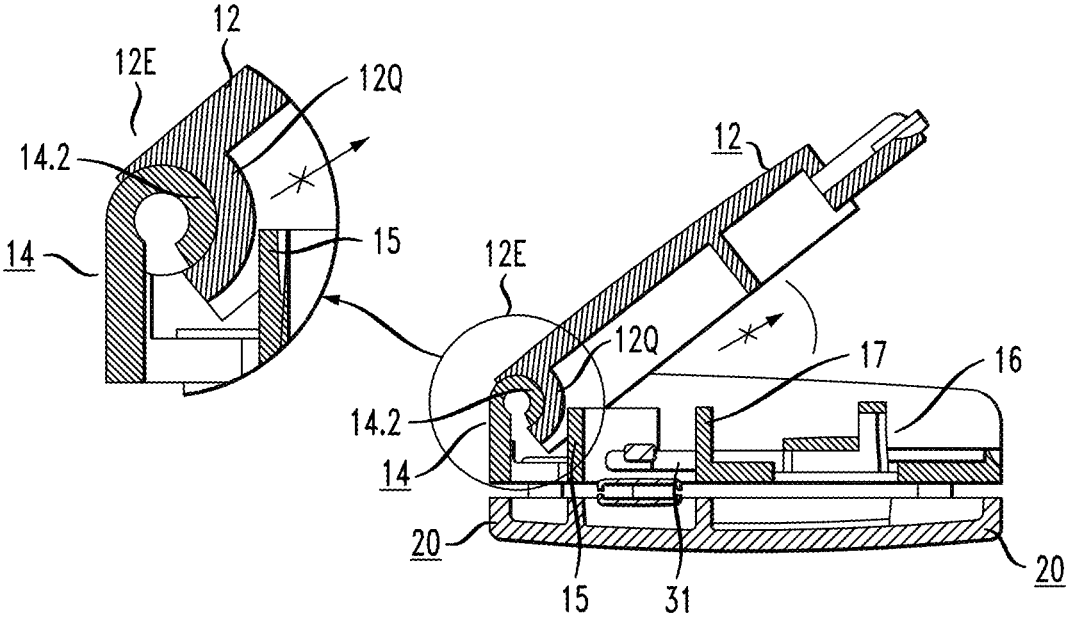
FIG. 10 shows the same elements as FIG. 9, in this case where the hinge pin has been removed and lid component been slightly raised, this view in particular illustrating the use of the quarter-round barrel and the vertical wall combination to prevent unwanted removal of the lid component.
Figure 11:
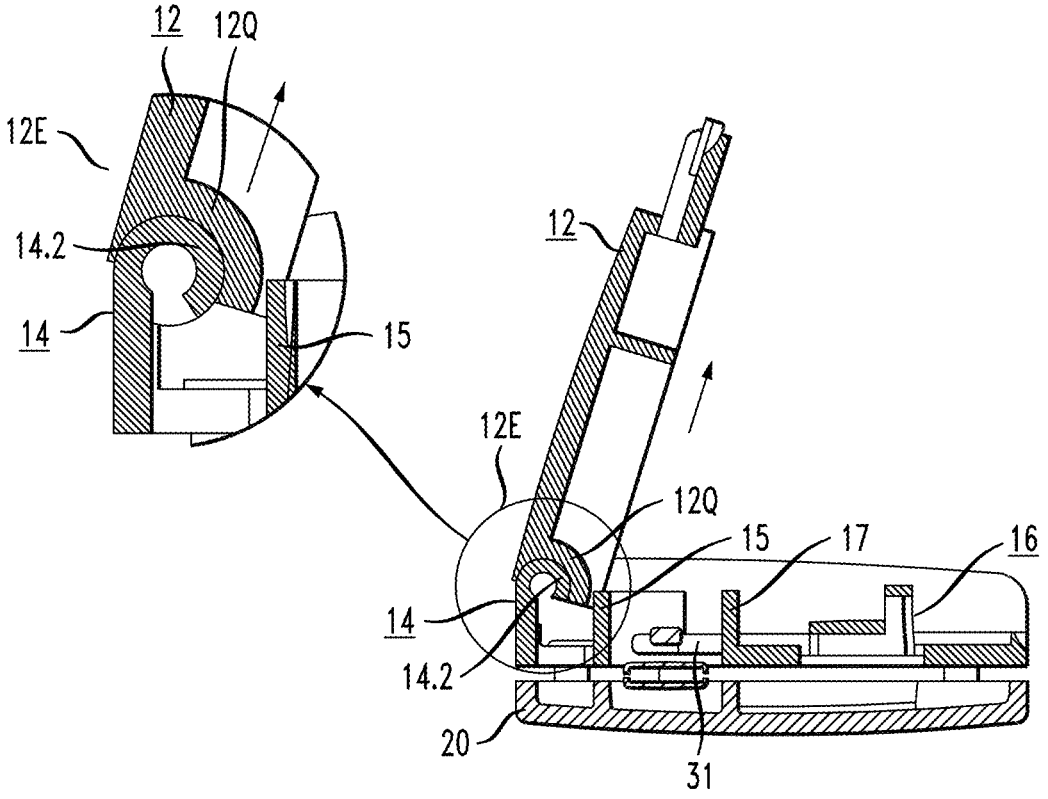
FIG. 11 demonstrates an approved position for removing the lid component from the remainder of the device, where upon permitted removal of the hinge pin, the lid may be completely lifted off.

An aspect of the present invention relates to the combination of lid 12, hinge assembly 14 and top component 16, and particularly to an arrangement of these components that prevents the lid from being removed from security enclosure 10 and exposing slider 8 of zipper 4. FIGS. 9-11 illustrate this concept. Referring to FIG. 9, lid component 12 is shown as including a quarter-round barrel element 12Q that extends along a rear edge 12E of lid component 12. Upon joining of lid component 12 to hinge assembly 14 by the insertion of hinge pin 14.1 through the joined pair, quarter-round element 12Q covers hinge barrel 14.2. An enlargement of the combination of rear edge 12E and hinge 14 is included in FIG. 9 to clearly show this arrangement.

Continuing with the description of FIG. 9, top component 16 includes a vertical wall 15 that functions as a stop and prevents the lid from being removed if hinge pin 14.1 is removed (which could be an attempt to gain access to the interior of the carrier bag). FIG. 10 shows the utilization of vertical wall 15 to block the movement of quarter-round barrel element 12Q when hinge pin 14.1 has been removed (either deliberately in an attempt to tamper with the enclosure, or during handling). By blocking the movement of quarter-round 12Q when hinge pin 14.1 has been removed, vertical wall 15 prevents lid 12 from being removed, as indicated by the X'd arrow in FIG. 10. A second, interior wall 17 is also shown in FIG. 10, where interior wall 17 is positioned to block anyone from gaining access to the "legs" portion of seal S, where the legs of seal S extend into recess 31. Once lid 16 is rotated to a position where quarter-round 12Q full clears vertical wall 15, it may be removed (or, alternatively, rotated into the fully open position as shown in FIG. 2).

The foregoing description of various embodiments is intended merely to be illustrative of the inventive principles. Thus, it is considered that various modifications, equivalents and other embodiments are within the scope of the invention as defined by the claims appended hereto.

What is claimed is:

1. A security enclosure for use with a carrier bag including a slidable fastener formed across a portion of the carrier bag to permit access thereto, the security enclosure, comprising a bottom component disposed along the underside a front panel of the carrier bag in an area where a closed termination of the slidable fastener is located;

a top component disposed over the front panel in alignment with the bottom component in a manner where the top and bottom components are fixed together in an immovable form, the top component including a recess for supporting a slider of the slidable fastener when fully closed; and a lid component attached to the top component via a hinge element, whereupon closure of the lid component over the top component, the slider of the slidable fastener is fully enclosed between the lid component and the top component, with a provided frangible seal positioned to fix the position of the lid component with respect to the top component, wherein the bottom component further comprises a seal lock pivot pin disposed perpendicular to a top surface of the bottom component, the seal lock pivot pin of a length sufficient to pass through a thickness of the front panel and an alignment hole formed in the top component and the top component further comprises a seal lock arm disposed along a side of the top component in a lever configuration, the seal lock arm including an aperture for aligning with the seal lock pivot pin when the seal lock arm is rotated adjacent to the side of the top component.

2. The security enclosure as defined in claim 1 wherein the slidable fastener comprises a zipper, the top component recess sized to support the slider of the zipper when the zipper is fully closed.

3. The security enclosure as defined in claim 1 wherein the hinge element is disposed parallel to the direction of movement of the slidable fastener such that the combination of the lid component, the hinge element, and the top component form a clam shell configuration for encasing the slider.

4. The security enclosure as defined in claim 1 wherein a first side termination of the top component includes a first set of hinge barrel elements and a first side termination of the lid component includes a second set of hinge barrel elements that are positioned in alignment with the first set of hinge barrel elements upon attachment of the lid component to the top component, the hinge element further comprising a hinge pin disposed to pass through aligned openings in the combination of the first and the second hinge barrel elements.

5. The security enclosure as defined in claim 4 wherein the second set of hinge barrel elements includes a covered far-end termination to prevent the hinge pin from passing through.

6. The security enclosure as defined in claim 4 wherein the top component includes a vertical wall disposed between the location of the second set of hinge barrel elements and the recess; and the first set of hinge barrel elements are formed as quarter-round elements of a thickness that creates contact with the vertical wall upon rotating the lid component upward from the top component, preventing removal of the lid component.

7. The security enclosure as defined in claim 1 wherein the top component further comprises a cap disposed to cover an exposed termination of the seal lock pivot pin when the seal lock arm is rotated into position.

8. The security enclosure as defined in claim 1 wherein the seal lock arm further comprises a cover element, disposed beyond the aperture, the cover element disposed over a portion of a positioned frangible seal.

9. The security enclosure as defined in claim 1 wherein the top component further comprises a clip member along its periphery at a location adjacent to the position of a frangible seal, wherein the clip member is configured to rotate over a portion of the frangible seal to secure its placement within the security enclosure.

* * * * *